United States Patent [19]

Uyama et al.

[11] Patent Number: 5,064,621

[45] Date of Patent: Nov. 12, 1991

[54] CIRCULATING FLUID-BED COMBUSTION APPARATUS

[75] Inventors: Kiyoshi Uyama; Koji Yamamoto; Haruhito Tsuboi; Toshihiko Iwasaki, all of Kawasaki, Japan

[73] Assignee: NKK Corporation, Tokyo, Japan

[21] Appl. No.: 642,306

[22] Filed: Jan. 18, 1991

[30] Foreign Application Priority Data

Jan. 19, 1990 [JP] Japan ..... 2-009580

[51] Int. Cl.[5] ..... F27B 15/08

[52] U.S. Cl. ..... 422/144; 422/145; 422/146; 422/147; 55/77; 55/345; 55/390

[58] Field of Search ..... 55/77, 79, 267, 269, 55/345, 390, 444; 462/144–147

[56] References Cited

U.S. PATENT DOCUMENTS 4,426,359 1/1984 Woebcke et al. ..... 422/145

4,951,611 8/1990 Abdulally et al. ..... 422/147 X

*Primary Examiner*—Charles Hart

*Attorney, Agent, or Firm*—Fleit, Jacobson, Cohn, Price, Holman & Stern

[57] ABSTRACT

A circulating fluid-bed combustion apparatus comprises a fluid-bed combustion chamber having a primary combustion air inlet and secondary combustion air inlet, the primary combustion air inlet arranged at the bottom of the fluid-bed combustion chamber and the secondary combustion air inlet being arranged in an intermediate portion of the fluid-bed combustion chamber; a layrinth separator for separating coarse particles from gases, which is positioned below the secondary combustion air inlet; a heat exchanger, into which combustion gases are led from the fluid-bed combustion chamber; a multicyclone for separating fine particles from gases discharged out of the heat exchanger; and a distributor for distributing particles separated in the multicyclone to an upper zone of the fluid-bed combustion chamber above the labyrinth separator and to a lower zone of the fluid-bed combustion chamber below the labyrinth separator.

15 Claims, 5 Drawing Sheets

CIRCULATING FLUID-BED COMBUSTION APPARATUS

BACKGROUND OF THE INVENTION

1. Field of the Invention

The present invention relates to a circulating fluid-bed combustion apparatus, which effectively combusts solid fuel such as coal.

2. Description of the Related Arts

Japanese Examined Patent Publication No. 28046/82 discloses a circulating fluid-bed combustion apparatus, which effectively combusts solid fuels by limiting the discharge of nitrogen oxides and sulfur oxides to a low level. In this combustion apparatus, a superficial velocity of fluidized gases in a fluid-bed combustion chamber is a terminal velocity of fluidized particles or more. The fluidized particles accompanying the gases are separated by a separator. The separated particles are returned to the combustion chamber through a circulation circuit. There are two features in this combustion apparatus. A first feature is that the particle residence time is long due to the circulation of the particles. A second feature is that the gases are strongly mixed with the particles by differences of the fluidizing velocities of the gases and particles.

This circulating fluid-bed combustion apparatus is schematically shown in FIG. 13. This apparatus comprises a fluid-bed combustion chamber 1, a separator 2, a particle recycling conduit 3, a heat exchange portion 4 comprising a boiler heat transfer surface and the like. A primary combustion air inlet 5 is positioned at the bottom of the combustion chamber 1. A secondary combustion air inlet 6 is positioned in an intermediate portion of the combustion chamber 1. A cooling surface 7 for recovering combustion heat is positioned in an upper space of the combustion chamber 1.

Pulverized solid fuels such as coal of from about 0.5 mm to 10 mm in particle size and a desulfurizing agent such as lime are charged into a lower portion of the fluid-bed combustion chamber. The solid fuels are fluidized by the primary combustion air blown from the primary combustion air inlet 5 and mixed with particles in the furnace. Since the solid fuels are rapidly mixed with the primary combustion air, the solid fuels are well ignited.

The combustion air is supplied in two stages and two-stage combustion is carried out. Flame under the secondary combution air inlet 6 is reducing flame having an air ratio of 1 or less, and flame above the secondary combustion air inlet 6 is oxidizing flame having an air ratio of 1 or more.

A low-temperature combustion is possible since the homogeneities of temperatures inside the combustion chamber 1 are attained by actively mixing the gases with the particles and a great amount of circulating particles possess a sufficient heat capacity. The temperature inside the combustion chamber 1 is kept at about 850° C. by the cooling surface 7 inside the combustion chamber 1.

Since the particles inside the combustion chamber have a distribution of certain particle sizes, coarse particles incapable of reaching a terminal velocity of the gases are also mixed with gases. The coarse particles blown upward together with fine particles form a fluidized bed. The coarse particles fall toward the bottom of the combustion chamber as the gases and particles move upwards. In this way, the particles circulate inside the combustion chamber. A suspension concentration of the particles in the combustion chamber is high in the lower portion thereof and low in the upper portion thereof due to the circulation of the particles inside the combustion chamber.

The amount of heat transfer on the cooling surface 7 inside the combustion chamber is varied by the suspension concentration of the particles. The amount of the particles blown upward from the bottom is regulated by varying the proportion of the primary and secondary combustion air. The amount of heat transfer on the cooling surface is regulated so that the combustion temperature can be a predetermined temperature.

Fuel particles become finer as combustion proceeds. When the fine particles reach the terminal velocity of the gases, the fine particles together with the gases are discharged out of the combustion chamber 1, and the particles are caught by the separator 2. The particles caught are returned again to the combustion chamber 1 through the recycling conduit 3. A combustible loss of the fuel particles is minimized by repeatedly carrying out the recycling of the gases and particles.

An amount of discharge of nitrogen oxides generated in a combustion process is limited to a low level due to the following reasons:

Firstly, the temperature inside the combustion chamber is low and homogeneous;

Secondly, the gases and particles are combusted in two stages; and

Thirdly, the fuel particles not yet combusted as reducing agents distribute in all the space of the combustion chamber.

On the other hand, since the desulfurizing agents such as lime stone and the like distribute in all the space of the combustion chamber and the desulfurizing agents are retained in the combustion chamber by the recycle of the particles for a long duration of time, an effective desulfurizing reaction is carried out.

Since the prior art circulating fluid-bed combustion apparatus has such a structure as described above, the following problems are pointed out:

(a) It is necessary to pass the high-temperature combustion gases of about 850° C. through the separator 2 immediately after the gases have been discharged out of the fluid-bed combustion chamber 1. A centrifugal separation type hot cyclone, which is usually formed of refractory due to conditions of its use, is used for the separator 2. Due to a great amount of high-temperature gases to be processed, a draft loss in the hot cyclone is large, which necessitates an auxiliary driving force. Moreover, the size of the hot cyclone is substantially equal to that of the fluid-bed combustion chamber. The great size of the hot cyclone requires a great space necessary for the circulating fluid-bed combustion apparatus. Further, due to the refractory used for the hot cyclone, much time is required for starting up the hot cyclone and maintenance labour is increased.

(b) The duration of time in a process from the hot cyclone 2 to the fluid-bed combustion chamber 1 through the recycling conduit 3 requires 10 to 20 sec., which is regarded as a long duration of time. Since this process is repeatedly carried out 10 to 100 times until particulate solid fuel particles are burnt out, a very long duration of time as a whole is required. Accordingly, the time constant of combustion is very large, which leads to a bad following-up during the load fluctuation.

(c) The distribution of the particle suspension concentration and the temperature inside the combustion chamber are regulated by changing the proportion of the distribution of the amount of the primary and secondary combustion air. The effect of denitration by means of the two-stage combustion is also affected by this proportion of the distribution of the primary and secondary combustion air. Accordingly, when an attempt is made to satisfy the conditions of both the temperature inside the combustion chamber and the denitration ability, the range of application of the prior art method is limited.

Relative to the above-described various problems, there is a combustion apparatus disclosed in PCT/ET No. 87/00729. An example of this combustion apparatus is shown in FIG. 14. A labyrinth separator 8, which is a non-centrifugal mechanical separator, is arranged in an upper space of a fluid-bed combustion chamber. A heat exchange portion 4 is arranged on the downstream side of the labyrinth separator 8. In this example, the particles, which were passed through the hot cyclone in the prior apparatus of FIG. 13, are instead circulated in the combustion chamber 1 by means of the labyrinth separator 8. Therefore, the problems due to the hot cyclone are solved. However, since the distribution of the suspension concentration of the particles is varied by the proportion of the distribution of the amount of the primary and the secondary combustion air as in the circulating fluid-bed combustion apparatus with the cyclone, the problem such that the range of operation is limited cannot be solved.

SUMMARY OF THE INVENTION

It is an object of the present invention to provide a circulating fluid-bed combustion apparatus which enables solid fuels such as coal to be effectively combusted.

To attain the above-described object, the present invention provides a circulating fluid-bed combustion apparatus, comprising:

a fluid-bed combustion chamber having a primary combustion air inlet and a secondary combustion air inlet, the primary combustion air inlet being arranged at the bottom of said fluid-bed combustion chamber and the secondary combustion air inlet being arranged in an intermediate portion of said fluid-bed combustion chamber;

a labyrinth separator for separating coarse particles from gases, which is positioned in the fluid-bed combustion chamber below the secondary combustion air inlet;

a heat exchanger, into which combustion gases are led from said fluid-bed combustion chamber;

a multicyclone for separating fine particles from gases discharged out of the heat exchanger; and a distributor for distributing particles separated in the multicylone to the portion of the fluid-bed combustion chamber above the labyrinth separator and to the portion of the fluid-bed combustion chamber below the labyrinth separator.

The above objects and other objects and advantages of the present invention will become apparent from the following detailed description, taken in conjunction with the appended drawings.

DESCRIPTION OF THE PREFERRED EMBODIMENT

Figure 1:
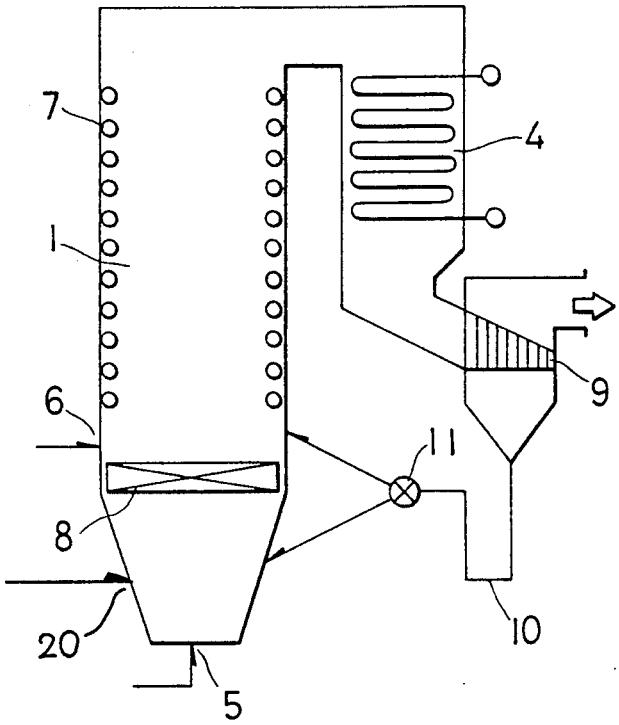
FIG. 1 is a schematic illustration showing a circulating fluid-bed combustion apparatus of the present invention.

The present invention will now be described with specific reference to FIG. 1. A primary combustion air inlet 5 is arranged at the bottom of a fluid-bed combustion chamber 1. A secondary combustion air inlet 6 is arranged in an intermediate portion of the fluid-bed combustion chamber 1. A labyrinth separator 8 is positioned just under the secondary combustion air inlet 6.

A cooling surface 7 is positioned in the fluid-bed combustion chamber 1. A heat exchanger 4 is positioned at an outlet at the top of the combustion chamber 1. A multicyclone 9 is arranged on the downstream side of the heat exchanger 4. Separated particles are returned to the combustion chamber through a recycling conduit 10. A distributor 11 is mounted on the recycling conduit 10. The distributor 11 returns the separated particles into an upper zone and a lower zone, above and below the labyrinth separator 8, respectively, in the combustion chamber 1 with an optional proportion of the distribution of the particles.

A sectional structure of the labyrinth separator 8 is shown in FIGS. 2 to 9.

A plurality of baffles are arranged in a row or an array at the same level in the combustion chamber so that the baffles interfere with gas flow 14. A second plurality of baffles arranged in a row or an array are positioned in the combustion chamber at a level higher than the first row array of baffles so that gases rising through the first row or array of baffles can strike those baffles in the second row or array. That is, the baffles at the higher level are offset from the baffles in the lower level so that the baffles at the higher level can fill up spaces among the baffles positioned at a lower level. What is called a labyrinth gas passage is formed. Combustion gases pass through this labyrinthine passage in zigzag. On the other hand, particles accompanying the combustion gases strike the surfaces of the baffles by the force of inertia, lose their momentum, separate from the gas flow and fall. The particles stick together when they strike the surfaces of the baffles and convert to a mass, which separates from the gas flow and drop.

Figure 2:
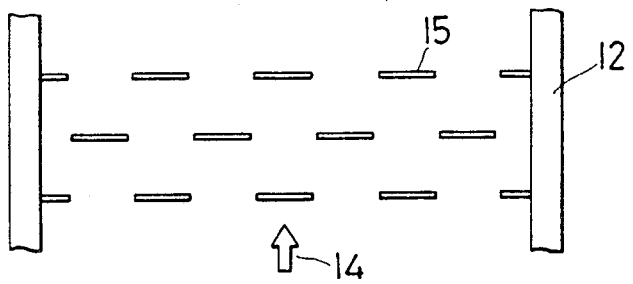
FIGS. 2 to 9 are partial sectional views showing a labyrinth separator of the present invention.
Figure 3:
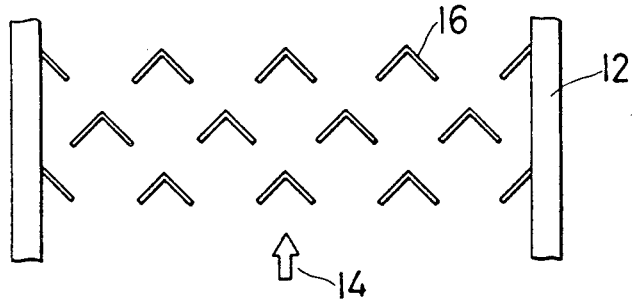
Figure 4:
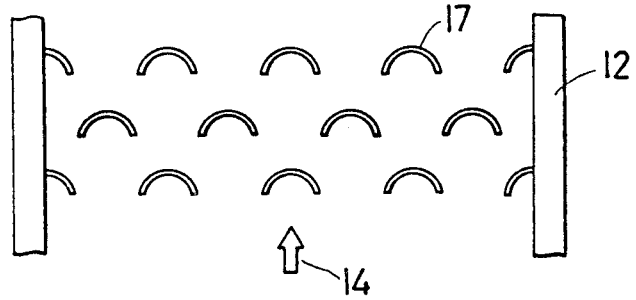
Figure 5:
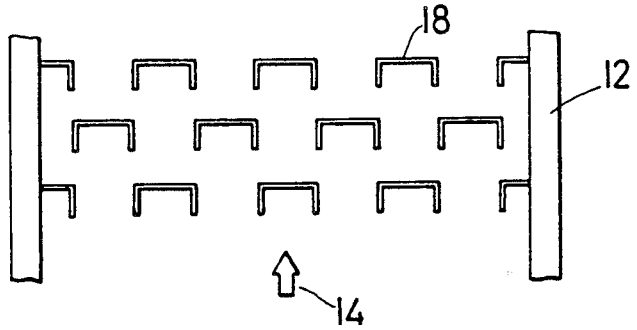
Figure 6:
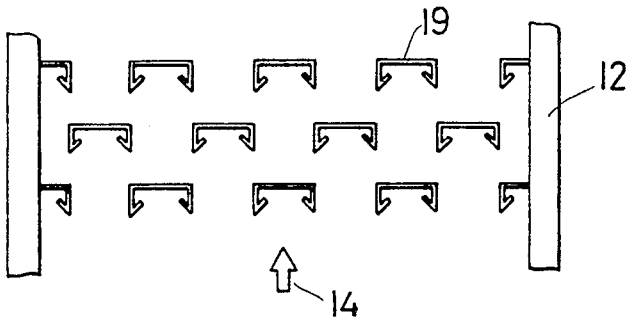

The baffles constituting the labyrinth separator 8 as shown in FIGS. 2 to 6 have no cooling means. The baffles 15 as shown in FIG. 2 is plate-like. Gases 14 rising from beneath strike the lower side of the plate-like baffle 15, which interferes with the gas flow. The baffles 16 shown in FIG. 3 is an angle bar. The baffle 17 shown in FIG. 4 is a pipe whose section is semi-circular. Gases 14 rising from beneath strike the inside surface of the semi-circular pipe. The baffle 18 as shown in FIG. 5 is a channel bar. The channel bars in FIG. 5 are positioned so that the channel portion surrounded by three sides can be directed downward. Gases 14 rising from beneath strike the channel portion, which interferes with the gas flow. The baffle 19 as shown in FIG. 6 is a channel bar, the edges of the opening of which are bent inwardly. Particles accumulate in the bent portion of baffle 19.

Figure 7:
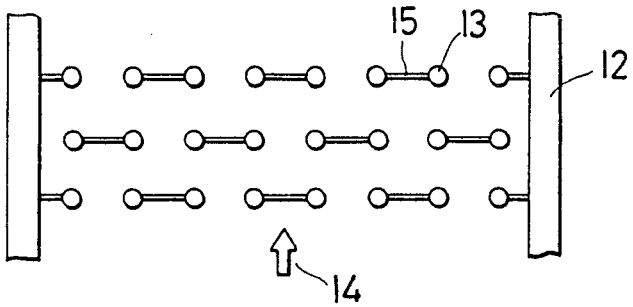
Figure 8:
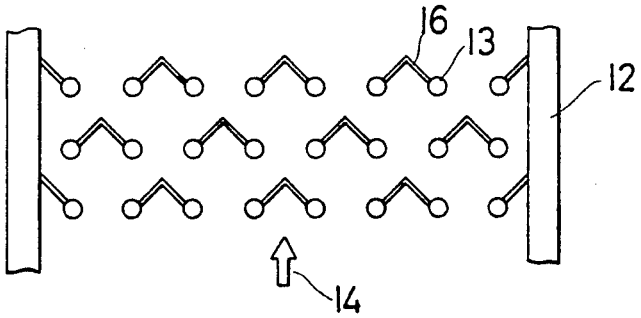
Figure 9:
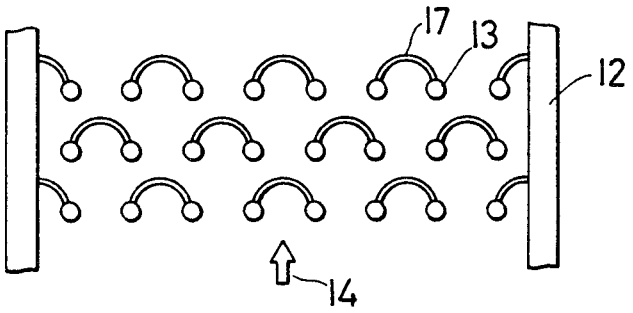

The labyrinth separator 8 as shown in FIGS. 7 to 9 possesses a cooling means associated with the baffles. The baffle as shown in FIG. 7 is composed of a flat plate 15 and cooling tubes 13 mounted at both edges of the flat plate 15. In this baffle, two cooling tubes 13 are connected to each other by means of the flat plate. The flat plate 15 is cooled by a cooling agent of the cooling tubes 13. The labyrinth separator 8 as shown in FIG. 8 is composed of angle bars 16 and cooling tubes 13 mounted at both ends of the angle bar. The labyrinth separator 8 as shown in FIG. 9 is composed of semi-circular pipe 17 and cooling tubes 13 mounted at both ends of the semi-circular pipe.

Figure 10:
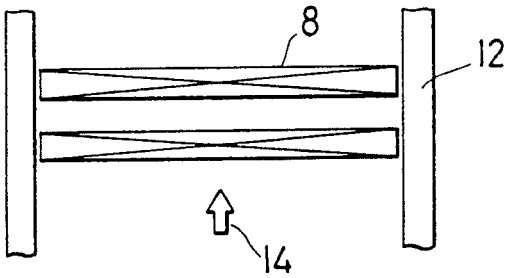
FIGS. 10 to 12 are explanatory views showing an arrangement of the labyrinth separator of the present invention.
Figure 11:
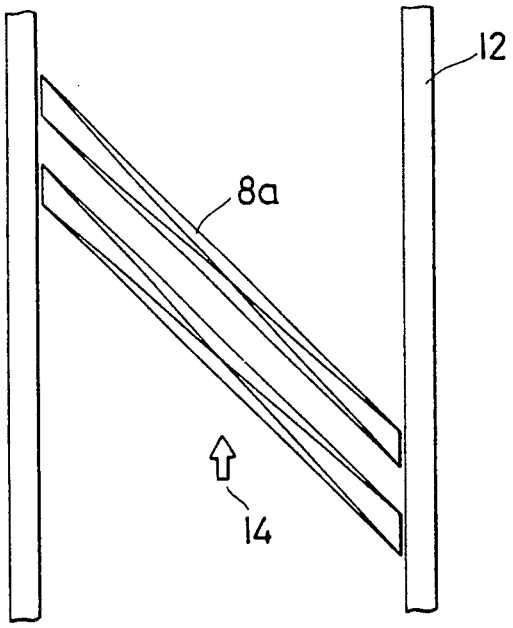
Figure 12:
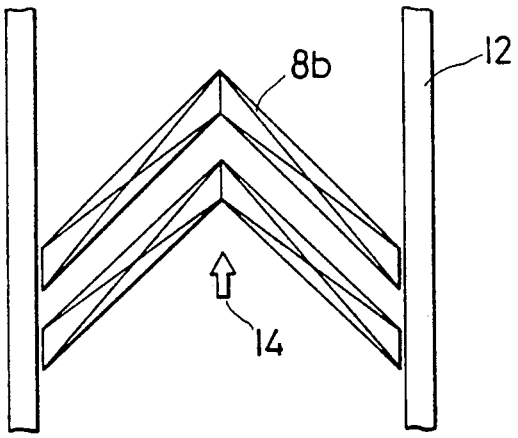
Figure 13:
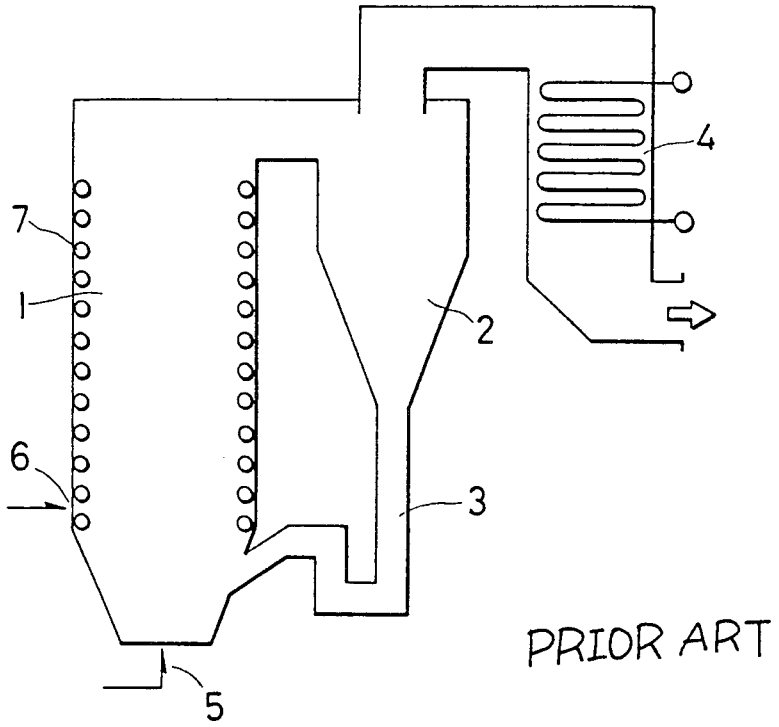
FIGS. 13 to 14 are schematic illustrations showing the prior art circulating fluid-bed combustion apparatus.
Figure 14:
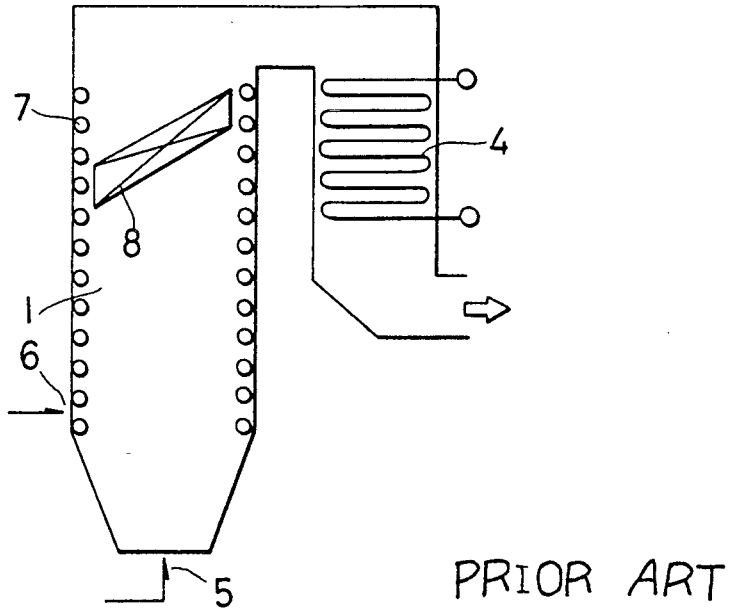

Several methods of arranging the labyrinth separator 8 are shown in FIGS. 10 to 12. As shown in FIGS. 10 to 12, more than one labyrinth separator 8, each of which contains a plurality of rows or arrays of baffles, can be used together to provide a longer labyrinth passage. The labyrinth separator 8 as shown in FIG. 10 is positioned at right angles relative to the gas flow, namely, horizontally. Mass of cohered particles accompanied by the gases drops just under the labyrinth separator 8. The labyrinth separator 8*a* as shown in FIG. 11 is arranged obliquely relative to the gas flow 14. That is, the labyrinth separator 8*a* slants downward to the right from the left wall surface to the right wall surface. The mass of cohered particles separated by means of the labyrinth separator 8*a* is led to the wall surface 12. The led mass of cohered particles drops along the wall surface 12. The labyrinth separator 8*b* as shown in FIG. 12 is positioned so that the central portion of the labyrinth separator 8*b* can be higher than the portions thereof in the circumference of the fluid-bed combustion chamber. That is, the labyrinth separator 8*b* is positioned in the form of chevron. Separated mass of cohered particles is led to both the wall surfaces drops along the wall surfaces 12. The wall 12 can either be the wall of the fluid-bed combustion chamber 1 or the wall of a frame in which the rows or arrays of baffles are mounted. Then, the work of the above-described circulating fluid-bed combustion apparatus will now be described.

Solid fuels such as coal and desulfurizing agents such as lime stone are charged into the fluid-bed combustion chamber 1 through blow-inlet 20, which is located lower than the labyrinth separator 8. Of course, the solid fuels and desulfurizing agents could be charged through separate blow-inlets. The solid fuels are pulverized into particles of from 0.5 to 10 mm in particle size. The solid fuels and desulfurizing agents charged into the fluid-bed combustion chamber are fluidized by primary combustion air blown from the primary combustion air inlet 5 positioned at the bottom of the combustion chamber 1 and the fluidized solid fuels and desulfurizing agents are mixed with particles in the furnace. Mixed solid fuels are ignited. As soon as the mixed solid fuels are ignited, volatile components begin to be separated from the solid fuels.

Coarse particles fluidized by the primary combustion air are separated by means of the labyrinth separator 8. Separated coarse particles drop to the bottom of the combustion chamber 1 and are fluidized again. The particle size of the coarse fuel particles decreases as combustion proceeds while the separation and fluidization of the particles are repeated, or the coarse fuel particles are converted to fine particles by means of mechanical shock due to fluidization of the particles or thermal shock or the like. The fuel particles, whose particle size is decreased or which is converted to fine particles, pass through the labyrinth separator 8 together with combustion gases.

In the portion of the fluid-bed combustion chamber 1 positioned above the labyrinth separator 8, the volatile components and minute fuel particles are combusted by the secondary combustion air blown in from the secondary combustion air inlet 6. When the combustion has begun, gases inside the combustion chamber 1 are simultaneously cooled by the cooling surface 7 arranged on the inside walls in the circumference of the combustion chamber, whereby a temperture inside the combustion chamber is kept at a predetermined temperature.

The combustion of the volatile components terminates at the outlet of the fluid-bed combustion chamber 1. Fine particles not yet combusted are separated by means of the multicyclone 9 following the heat exchanger 4. The fine particles not yet combusted, which have been separated, are sent to the distributor 11 through the recycling conduit 10. The distributor 11 distributes the particles not yet combusted to the upper zone of the fluid-bed combustion chamber above the labyrinth separator 8 and to the lower zone of the fluid-bed combustion chamber below the labyrinth separator 8. The distributor 11 can be a valve, having a known valve structure. The distributor 11 simultaneously distributes or directs fine particles from recycling conduit 10 to both the upper zone of the fluid-bed combustion chamber above the labyrinth separator and the lower zone of the fluid-bed combustion chamber below the labyrinth separator. By varying the degree of opening of the distributor 11, the distribution ratio of the fine particles to the upper and lower zones of the fluid-bed combustion chamber can be controlled.

If the total amount of the particles not yet combusted is returned to the upper zone of the fluid-bed combustion chamber above the labyrinth separator, the suspension concentration of particles in the upper zone of the combustion chamber is increased. On the other hand, if the total amount of the particles not yet combusted is returned to the lower zone of the combustion chamber below the labyrinth separator 8, it takes much time for the particles not yet combusted to pass the labyrinth separator 8 due to cohesion of the particles and interference of coarse particles with the particles not yet combusted, and the suspension concentration of the particles in the upper zone above the labyrinth separator is decreased.

The suspension concentration of the particles not yet combusted in the space above the labyrinth separator 8 can be regulated by regulating the proportion of distribution of the particles not yet combusted to the upper zone of the fluid-bed combustion chamber above the labyrinth separator and to the lower zone of the fluid-bed combustion chamber beneath the labyrinth separator. The temperature inside the zones of the combustion chamber are optimized by regulating the suspension concentration of the particles. During the regulation of the proportion of distribution of the particles not yet combusted, the ratio of the primary combustion air to the secondary combustion air is regulated to be the optimum value on the basis of denitration performance.

The circulating fluid-bed combustion apparatus of the present invention has the effect as described below.

The labyrinth separator 8 arranged inside the fluid-bed combustion chamber 1 has the suspension performance substantially equal to that of the aforementioned centrifugal separator with a low pressure loss compared with the centrifugal separator such as the cyclone. The above-mentioned separation performance can be seen in the case of a high suspension concentration of the particles inside the fluid-bed combustion chamber.

Since the multicyclone 9 processes gases cooled by the heat exchanger 4 in the apparatus of this invention, a cyclone made of steel plate without using refractory can be used. The multicyclone 9 has a low pressure loss in comparison with a hot cyclone used in the prior art circulating fluid-bed combustion apparatus.

Coarse particles out of the fluidized particles inside the fluid-bed combustion chamber 1 are concentrated in the space under the labyrinth separator 8. In the combustion chamber 1 as a whole, the total amount of the fluidized particles is small compared with that in the prior art circulating fluid-bed combustion apparatus, and the pressure loss due to the fluidization of particles is decreased.

Accordingly, the pressure loss for separating the particles totaling the pressure loss in the labyrinth separator 8 and the pressure loss in the multicyclone 9 as well as the pressure loss for fluidization of the particles are low compared with that in the prior art circulating fluid-bed combustion apparatus. Due to the low pressure loss, the auxiliary driving force is decreased.

Since a hot cyclone, for which refractory is used, is not used in the inventive apparatus, the effects such that starting time for the cyclone can be decreased, that maintenance work is decreased, and that space for the cyclone is decreased can be produced.

Particles circulating through the multicyclone 9 are fine compared with particles circulating through the hot cyclone in the prior art circulating fluid-bed combustion chamber, and the amount of particles retained in the combustion chamber 1 is relatively small. Since the particle size of the above-mentioned particles is small and the amount of the particles retained in the combustion chamber 1 is small, the time constant of combustion is decreased, which enhances controllability of the multicyclone.

The particles not yet combusted can be returned to the upper zone of the fluid-bed combustion chamber above the labyrinth separator 8 and to the lower zone of the fluid-bed combustion chamber below the labyrinth separator 8 by means of the distributor 11 mounted on the recycling conduit 10 with an optional proportion of the distribution. The suspension concentration of the particles in the upper zone above the labyrinth separator 8 is regulated by regulating the proportion of the distribution of the particles. The temperature inside the combustion chamber can be optimized by the regulation of the suspension concentration of the particles. On the occasion of regulating the proportion of the distribution of the particles not yet combusted, the ratio of the primary combustion air to the secondary combustion air is regulated to be the most appropriate value on the basis of the denitration performance.

What is claimed is:

1. A circulating fluid-bed combustion apparatus, comprising:

a fluid-bed combustion chamber having a primary combustion air inlet and a secondary combustion air inlet, the primary combustion air inlet being arranged at the bottom of said fluid-bed combustion chamber and the secondary combustion air inlet being arranged in an intermediate portion of said fluid-bed combustion chamber;

a labyrinth separator for separating coarse particles from gases, positioned in said fluid-bed combustion chamber below the secondary combustion air inlet;

a heat exchanger, into which combustion gases discharged from said fluid-bed combustion chamber are led;

a multicyclone downstream from said heat exchanger for separating fine particles from gases discharged out of the heat exchanger; and a distributor for distributing particles separated in the multicyclone to an upper zone of the fluid-bed combustion chamber above the labyrinth separator and to a lower zone of the fluid-bed combustion chamber below the labyrinth separator.

2. The apparatus of claim 1, wherein said labyrinth separator comprises a plurality of baffles arranged so as to interfere with a gas flow from the lower zone to the upper zone of the fluid-bed combustion chamber.

3. The apparatus of claim 2, wherein said baffles are in the form of flat plates.

4. The apparatus of claim 2, wherein said baffles are in the form of angle bars.

5. The apparatus of claim 2, wherein said baffles are in the form of semi-circular pipes.

6. The apparatus of claim 2, wherein said baffles are in the form of channel bars.

7. The apparatus of claim 6, wherein edges of an opening of each channel bar are bent inwardly toward the inside of the channel bar.

8. The apparatus of claim 2, wherein each said baffle comprises a flat plate and cooling tubes mounted at both edges of the flat plate.

9. The apparatus of claim 2, wherein each said baffle comprises an agle bar and cooling tubes mounted at both edges of the angle bar.

10. The apparatus of claim 1, wherein each said baffle comprises a semi-circular pipe and cooling tubes mounted at both edges of the semi-circular pipe.

11. The apparatus of claim 1, wherein said labyrinth separator is arranged horizontally.

12. The apparatus of claim 1, wherein said labyrinth separator is arranged obliquely relative to a gas flow from the lower zone to the upper zone of the fluid-bed combustion chamber.

13. The apparatus of claim 1, wherein said labyrinth separator has a central portion and a surrounding edge portion, said central portion extending upwardly in the fluid-bed combustion chamber higher than said edge portion.

14. The apparatus of claim 1, wherein said multicyclone is of steel plate.

15. The apparatus of claim 2, wherein said plurality of baffles is arranged in at least a first row of spaced apart baffles and a second row of baffles being spaced apart from and positioned above said first row of baffles, the baffles in said first and second row of baffles being offset such that baffles in said second row of baffles extend over spaces between baffles in said first row of baffles.

* * * * *